United States Patent [19]

Hendry et al.

[11] 4,076,990

[45] Feb. 28, 1978

[54] TUBE TARGET FOR FUSION NEUTRON GENERATOR

[75] Inventors: George O. Hendry, Napa; John L. Hilton, Walnut Creek, both of Calif.; Jinchoon Kim, Oak Ridge, Tenn.

[73] Assignee: The Trustees of the University of Pennsylvania, Philadelphia, Pa.

[21] Appl. No.: 620,715

[22] Filed: Oct. 8, 1975

[51] Int. Cl.[2] ..... H01J 7/24; H01J 39/00

[52] U.S. Cl. ..... 313/61 S; 250/499; 313/32

[58] Field of Search ..... 313/22, 23, 30–32, 313/61 R, 61 S; 250/499, 500, 526

[56] References Cited

U.S. PATENT DOCUMENTS

| | | | |
|---|---|---|---|
| 1,459,417 | 6/1923 | Schwerin | 313/31 |
| 2,090,636 | 8/1937 | Olshevsky | 313/30 |
| 2,935,633 | 5/1960 | Peters | 313/32 |
| 3,414,757 | 12/1968 | Levin et al. | 313/30 |
| 3,417,245 | 12/1968 | Schmidt | 313/61 R |
| 3,454,827 | 7/1969 | Brown | 313/32 X |
| 3,617,798 | 11/1971 | Marchese et al. | 313/31 X |

*Primary Examiner*—Gerard R. Strecker
*Attorney, Agent, or Firm*—Paul & Paul

[57] ABSTRACT

A target for a fusion neutron generator consisting of planar arrays of parallel tubes through which a cooling liquid is circulated. The target is relatively thin, and can be used to intercept two ion beams simultaneously, one on the front and the other on the back of the target. Two mixed ion beams, each containing a mixture of deuterium and tritium ions are accelerated into both sides of the water-cooled chromium plated copper-tube target whereby reactions occur yielding 14 MeV neutrons. At typical operating conditions of 170 keV and 300 mA total beam current, the neutron yield with a mixture of deuterium and tritium gas is approximately 6 $\times 10^{12}$ n/sec for an effective beam spot of 5.5 centimeters diameter.

14 Claims, 4 Drawing Figures

TUBE TARGET FOR FUSION NEUTRON GENERATOR

BACKGROUND OF THE INVENTION

This invention relates generally to the construction of a compact target for use with a neutron fusion generator to produce 14 MeV neutrons and more particularly to a method and means of constructing a neutron producing target suitable for radio therapy applications.

Recently, there has been substantial interest in monoenergetic 14 MeV neutron sources for use in conjunction with fast neutron radiotherapy and various material studies. In general, the required neutron source intensities are $10^{12}$ to $10^{13}$ n/sec for neutron therapy use and flux densities of greater than $10^{13}$ n/per centimeter $^2$ per second are required for material studies. Achieving these intensities, has been a central problem in 14 MeV source development programs.

Ideally, source targets for use with the above applications should be compact and for the reasons outlined below, thin. Flat plate targets are not acceptable for such applications because they tend to heat and deform. The thickness of a flat target necessary to insure the structural integrity of the target makes it difficult to illuminate the target on both sides without excessive neutron absorption in the target.

SUMMARY OF THE INVENTION

This invention contemplates the use of planar arrays of parallel tubes cooled by an internally circulated water for use as a fusion neutron source target. The target is relatively thin, so that it can be illuminated on both sides by the ion beams to produce neutrons without excessive neutron absorption in the target. The size of the tubing used, and the materials chosen, provide for a target which can supply a continuous high intensity flow of 14 MeV neutrons.

Accordingly, it is the primary object of this invention to provide a continuous high intensity source of 14 MeV neutrons.

It is another object of this invention to provide a relatively long-lived 14 MeV neutron target.

It is still another object of this invention to provide a target upon which multiple neutron producing ion beams can be impinged simultaneously.

It is another object of this invention to provide a neutron producing target particularly suitable for radiotherapy applications.

Other objects and advantages of this invention will become apparent from a consideration of the following description in connection with the drawings.

DESCRIPTION OF THE PREFERRED EMBODIMENT

Figure 1:
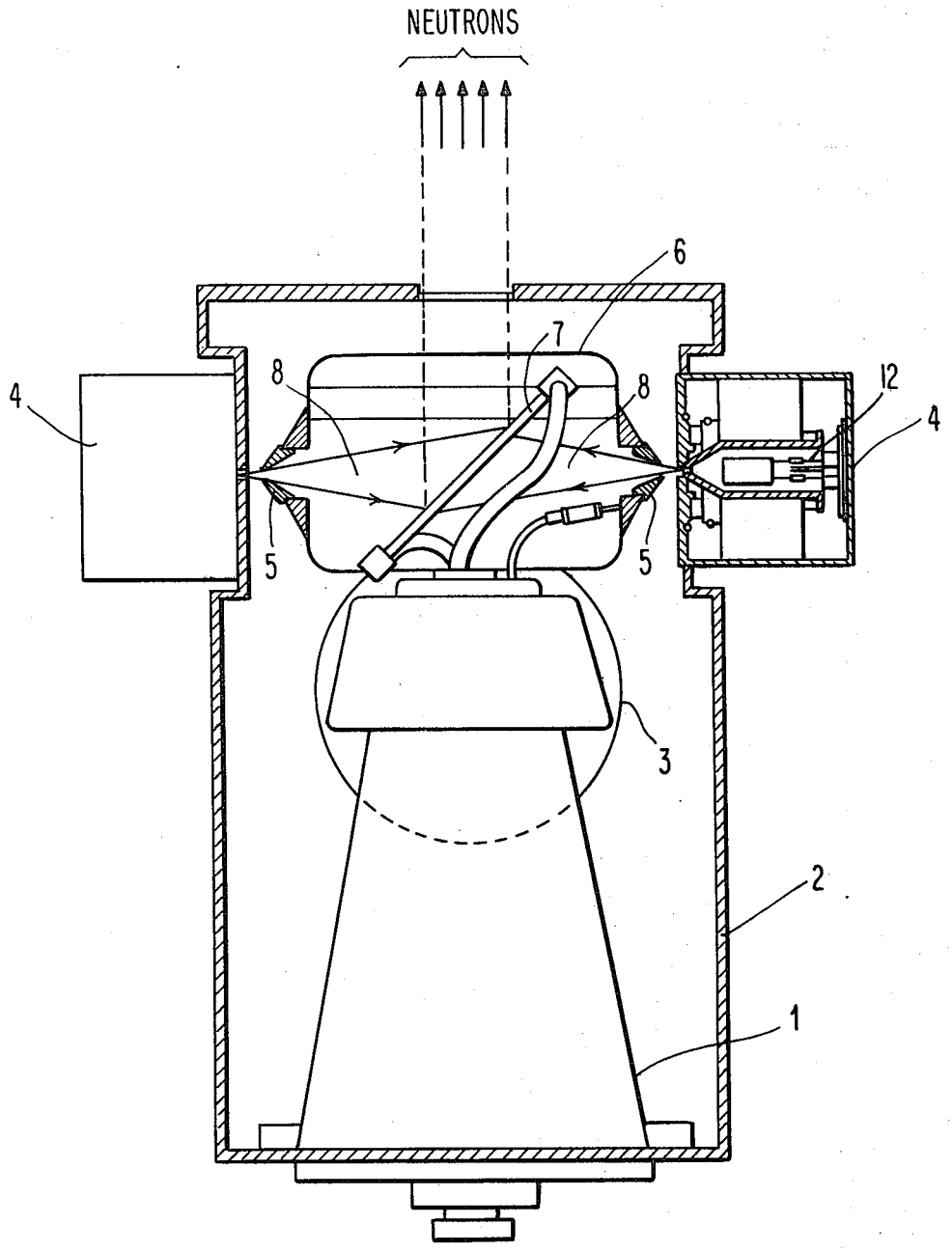
FIG. 1 illustrates the generel layout and components of a compact drive-in-target 14 MeV neutron generator.

FIG. 1 illustrates the general layout and components of a compact drive-in target 14 MeV neutron generator. The described machine includes a combination high voltage termination, target support, and target cooling water isolation coil 1; a vacuum envelope 2; a means of evacuating the vacuum chamber 3; two duoplasmatron ionsources at ground potential which produce a plasma containing both deuterium and tritium ions 4; two extractor electrodes at approximately 200,000 volts negative potential with respect to the ionsources 5; a Faraday cage which supports the extractor electrodes and encloses the target 6; a thin two-sided target which is formed from an array of chromium-plated copper tubes 7; and two ion beams 8; each containing a mixture of deuterium and tritium ions which strike the target and produce 14 MeV neutrons as shown.

Figure 2:
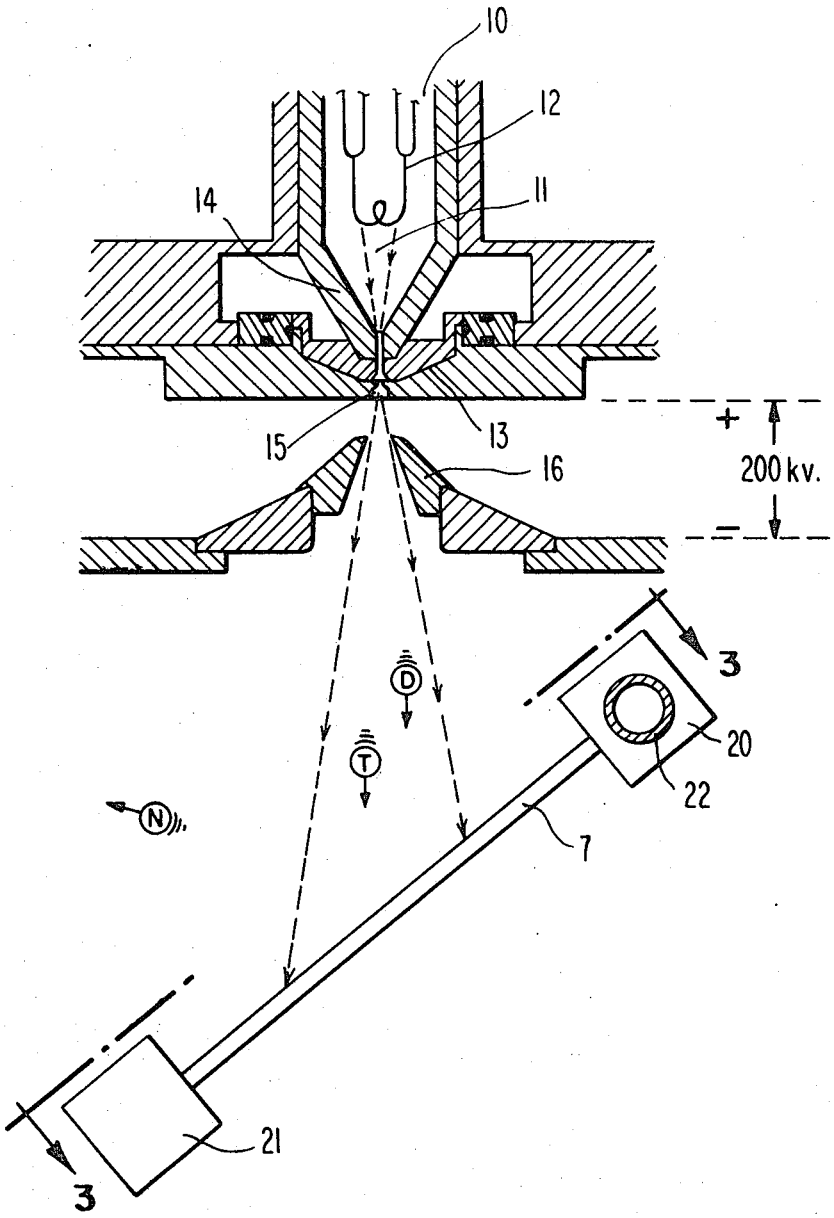
FIG. 2 is a detailed view showing the relationship of the ion source component, the acceleration region, and the target.

FIG. 2 is a more detailed view showing the relationship of the ion source components, the acceleration region and the target. A mixture of approximately 50% deuterium - 50% tritium gas is fed into the filament chamber 10 of the ion source and is ionized in an electric arc discharge 11 which runs between the ionsource filament 2 and the ionsource anode 13. An intermediate electrode 14 serves to compress the arc plasma thus producing a high density plasma rich in atomic ions. The plasma which contains both deuterium and tritium ions is then expanded in the ionsource expansion cup 15. An intense electric field of the order of 200,000 volts per centimeter is formed between the ionsource anode and the extractor electrod 16. This electric field serves to extract ions from the plasma in the ionsource expansion cup and accelerate them through a hole in the extractor electrode. The resulting accelerated ion beam containing approximately 50% deuterium and 50% tritium ions strikes the tube target 7.

Figure 3:
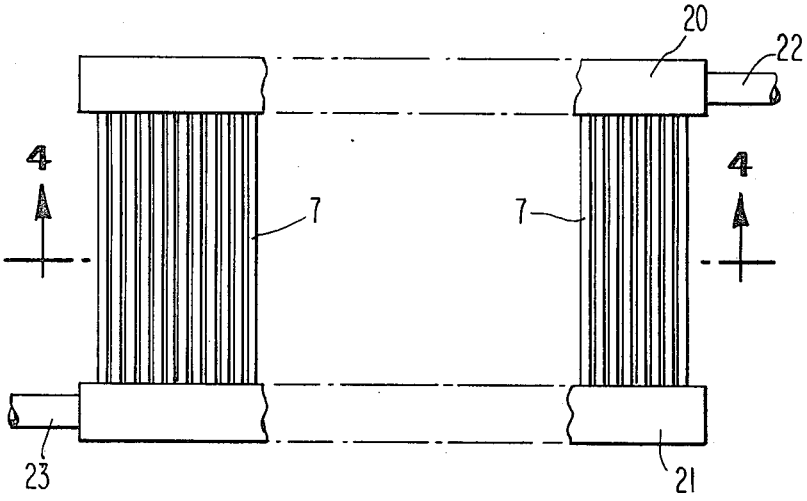
FIG. 3 is a plan view of the tube target.
Figure 4:
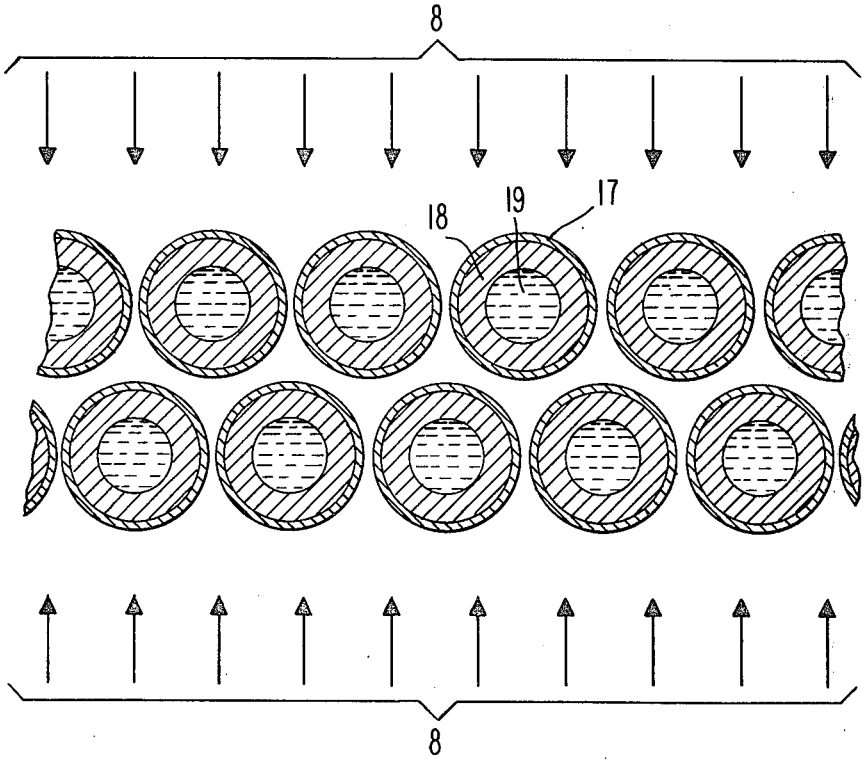
FIG. 4 is a cross-sectional view of the tube target.

FIG. 4 illustrates a sectional view of the tube target of FIG. 3. The targer is struck on either side by opposed beams 8, each containing a mixture of deuterium and tritium ions. The tritium ions in the beam strike the chromium layer 17 on the surface of the tubes 18. This layer is several one thousandths of an inch thick. The heat generated by the ions striking the target is carried off by water which flows in the center of the tubes 19.

FIG. 3 shows a broadside view of the tube target of FIG. 2, utilizing similar numbers thereto. In FIG. 3, a coolant conduit 22 is coupled to a first manifold 20, which in turn provides coolant to each of the tubes 7 of the planar, parallel array. On the opposite ends of the tubes, another conduit 23 is coupled to a second manifold 21. It is unimportant whether the coolant is delivered at 22 and withdrawn at 23, or vice versa. The target size can, of course, vary; but representative dimensions are as follows:

| | |
|---|---|
| Number of tubes | 60 (two planar arrays of 30) |
| Tube length | 14 cm. |
| Tube outer diameter | .236 cm. (.244 cm when chromium-plated) |
| Tube inner diameter | .14 cm. |

The tubes are hard-soldered to manifolds and in use the target is supported at an angle of 45° to two parallel opposed ion beams as shown in FIGS. 1 and 2. The tubes are very closely spaced as shown in FIG. 4. Water is circulated through the tubes to cool them.

The tritium ions in the ion beam strike the target and are buried in the chromium layer. The deuterium ions in the beam also strike the target and are buried in the chromium layer. The targer is thus self-loading and self-replenishing. A small fraction of the incoming deuterium ions fuse with the tritium ions previously buried producing 14 MeV neutrons via the $^3H(d,n)^4He$ reaction. Similarly, a small fraction of the incoming tritium ions fuse with deuterium ions previously buried forming 14 MeV neutrons via the $^2H(t,n)^4He$ reaction.

The use of chromium as a target surface material is important to this apparatus. Previously used materials such as zirconium and titanium form hydrides with poor mechanical properties which will not withstand for long periods of time the intense ion beams necessary for production of intense neutron beams. These hydride targets when used in a drive-in configuration have had outputs limited to less than $1 \times 10^{12}$ neutrons per second. A chromium surface on the target tubes has under the drive-in conditions herein described produced 5.6 $\times 10^{12}$ neutrons per second. (A High Yield Neutron Generator for Radiotherapy Purposes, J. T. Brennan, et al., British Journal of Radiology, March 1973, p. 233)

The neutron target described herein is constructed from an array of small tubes. It is apparent from FIG. 3 that the maximum local power density on each tube occurs at the point on the tube which is perpendicular to the incident beam. All other parts of the tube are struck obliquely by the beam which results in a lower power density. It is clear therefore that the average power density on such a target is lower than that on a conventional flat plate target. Careful selection of the tube wall thickness and the tube diameter substantially reduces the maximum temperature surface in comparison to that achievable with a conventional flat plate target. The tube wall thickness can be optimized by solving two-dimensional Laplace's equation for heat transfer in the tube wall, as described by J. Kim in the Cyclotron Corporation Report No. 6010 (1973) in his article entitled "Solution of Heat Transfer Problem Associated with the Neutron Generator Tube Target Design".

A second advantage of the tube target is the natural strength of a cylindrical shape in comparison to a plate. A flat plate will often deform under high temperature, thus reducing its ability to cool itself. A tube can withstand substantially higher temperatures and pressures before this occurs.

A third advantage of the tube target lies in its relative thickness. This in turn permits use of both sides of the target for neutron production without excessive neutron absorption in the target.

Part of the above-described arrangement is previously developed art. The acceleration system in particular was described by O. B. Morgan, G. C. Kelley, and R. C. Davis, *Review of Scientific Instruments,* 38, 467 (1967). The use of a drive-in target utilizing ka mixed beam of deuterium and tritium ions has also previously been used in a sealed tube 14 MeV neutron generators. These existing drive-in target 14 MeV generators have, however, been limited in output to less than $1 \times 10^{12}$ neutrons per second due to their targets which are made of hydride-forming materials deposited on a flat copper plate. 9

In summary, the choice of a liquid-cooled structure of chromium-plated copper tubes has made it possible to create a compact source of 14 MeV neutrons of particular value in twin-ion-beam fusion neutron generators. The new and novel target source can be illuminated by ion beams simultaneously on both sides to produce a continuous, high intensity supply of 14 MeV neutrons.

What is claimed is:

1. A neutron-producing target for use with a fusion neutron generator comprising:

an array of closely-spaced parallel neutron generating tubes arranged in planar rows, the neutrons being generated in response to ions impinging upon said tubes;

a first, coolant input manifold connecting said tubes at respective first ends thereof;

a second, coolant withdrawal manifold connecting said tubes at respective ends thereof opposite said first ends;

a cooling liquid; and means for coupling said liquid to said first manifold and for withdrawing fluid from said second manifold, whereby said liquid is passed through said tubes in parallel fashion with respect to one another.

2. The device in accordance with claim 1 wherein the cooling liquid is water.

3. The device in accordance with claim 2 wherein the array comprises two planar rows of equal-length tubes.

4. The device in accordance with claim 3 wherein the tubes are cylindrical.

5. The device in accordance with claim 4 wherein the tubes are made of chromium-plated copper.

6. The device in accordance with claim 5 wherein the thickness of the walls of the tubes has been optimized to provide maximum heat transfer to the cooling liquid.

7. A planar neutron-producing target for use with a fusion neutron generator having two opposed ion beams wherein the plane of the target is oriented 45° from the axis of the ion beams and wherein said target comprises:

an array of closely-spaced parallel neutron generating tubes arranged in planar rows, the neutrons being generated in response to ions impinging upon said tubes;

a first, coolant input manifold connecting said tubes at respective first ends thereof;

a second, coolant withdrawal manifold connecting said tubes at respective ends thereof opposite said first ends;

a cooling liquid; and means for coupling said liquid to said first manifold and for withdrawing fluid from said second manifold, whereby said liquid is passed through said tubes in parallel fashion with respect to one another.

8. The device in accordance with claim 7 wherein the cooling liquid is water.

9. The device in accordance with claim 8 wherein the array comprises two planar rows of tubes.

10. The device in accordance with claim 9 wherein the tubes are cylindrical.

11. The device in accordance with claim 10 wherein the tubes are made of chromium-plated copper.

12. The device in accordance with claim 11 wherein the thickness of the walls of the tubes has been optimized to provide maximum heat transfer to the cooling liquid.

13. The device in accordance with claim 5 wherein the chromium plating is in the range 0.00X inches thick.

14. The device in accordance with claim 11 wherein the chromium plating is in the range of 0.00X inches thick.

* * * * *

UNITED STATES PATENT OFFICE

CERTIFICATE OF CORRECTION

Patent No. 4,076,990 Dated February 28, 1978

Inventor(s) George O. Hendry, John L. Hilton and Jinchoon Kim

It is certified that error appears in the above-identified patent and that said Letters Patent are hereby corrected as shown below:

Col. 2, line 26 change "electrod" to --electrode--.

Col. 2, line 33, change "targer" to --target--.

Col. 2, line 65, change "targer" to -- target --.

Col. 3, line 50, change "ka" to --a--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*